US010344393B2

(12) United States Patent
Sarsanedas Millet et al.

(10) Patent No.: US 10,344,393 B2
(45) Date of Patent: Jul. 9, 2019

(54) DEVICE FOR BURNISHING AND SMOOTHING METAL PARTS

(71) Applicant: STEROS GPA INNOVATIVE, S.L., Barcelona (ES)

(72) Inventors: Pau Sarsanedas Millet, Barcelona (ES); Pau Manuel Narcis Guasch Piriz, Barcelona (ES); Arnau Garrell Bunuel, Barcelona (ES); Gerard Tordera Xandri, Barcelona (ES)

(73) Assignee: STEROS GPA INNOVATIVE, S.L., Barcelona (ES)

( * ) Notice: Subject to any disclaimer, the term of this patent is extended or adjusted under 35 U.S.C. 154(b) by 9 days.

(21) Appl. No.: 15/300,223

(22) PCT Filed: Mar. 26, 2015

(86) PCT No.: PCT/ES2015/070224
§ 371 (c)(1),
(2) Date: Sep. 28, 2016

(87) PCT Pub. No.: WO2015/144961
PCT Pub. Date: Oct. 1, 2015

(65) Prior Publication Data

US 2017/0226657 A1 Aug. 10, 2017

(30) Foreign Application Priority Data

Mar. 28, 2014 (ES) ..... 201430426 U

(51) Int. Cl.
*C25F 7/00* (2006.01)
*C25F 3/16* (2006.01)
*C25F 3/22* (2006.01)

(52) U.S. Cl.
CPC ..... *C25F 3/16* (2013.01); *C25F 3/22* (2013.01); *C25F 7/00* (2013.01)

(58) Field of Classification Search
None
See application file for complete search history.

(56) References Cited

U.S. PATENT DOCUMENTS 2,782,160 A 2/1957 Treuhaft et al.
5,135,632 A * 8/1992 Weber ..... C25F 7/00 204/224 M (Continued)

FOREIGN PATENT DOCUMENTS

EP 0962554 A2 12/1999

OTHER PUBLICATIONS

English Translation of International Search Report of PCT/ES2015/070224 dated May 19, 2015.

(Continued)

*Primary Examiner* — Stefanie S Wittenberg
(74) *Attorney, Agent, or Firm* — Amster, Rothstein & Ebenstein LLP

(57) ABSTRACT

A device for burnishing and smoothing metal parts, particularly suitable for use in mechanical-galvanic processes, comprising a main body having a fastening disc to which guides are radially coupled and the body of which includes at least three mobile propelling systems which are actuated by electro-mechanical means and move in a synchronized concentric manner, approaching and moving away from the central point and acting on a rotating frame from equidistant angles. The frame is configured to secure pieces to be treated and it also has a detachable head that is disposed centrally above a cylindrical tank. The propelling systems, provided with brushes, move from an open position in which they remain separate from one another and at a distance from the center, into a closed position in which they are joined to one another in the center of the tank, coming into contact with the structure containing the parts to be treated.

9 Claims, 4 Drawing Sheets

(56) References Cited

U.S. PATENT DOCUMENTS

| | | | | |
|---|---|---|---|---|
| 6,156,187 | A * | 12/2000 | Akagi | B23H 5/08 205/663 |
| 2006/0272957 | A1 * | 12/2006 | Lamphere | B23H 9/10 205/641 |
| 2008/0053841 | A1 * | 3/2008 | Baertsch | C23C 14/021 205/640 |

OTHER PUBLICATIONS

Written Opinion in Spanish Language of PCT/ES2015/070224 dated May 18, 2015.

* cited by examiner

FIG. 4-A
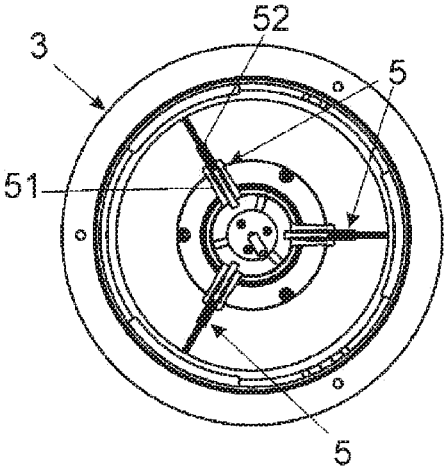
FIG. 4-B
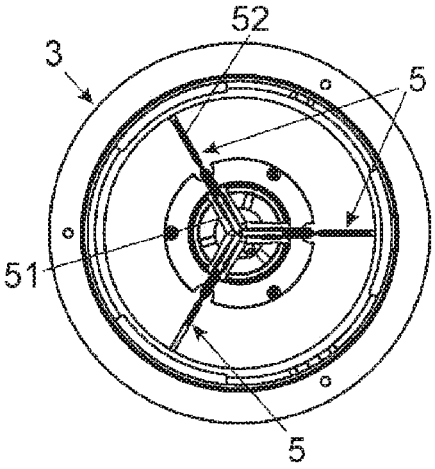
FIG. 5-A
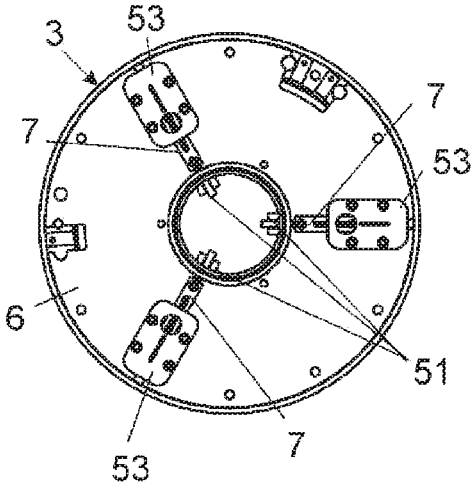
FIG. 5-B
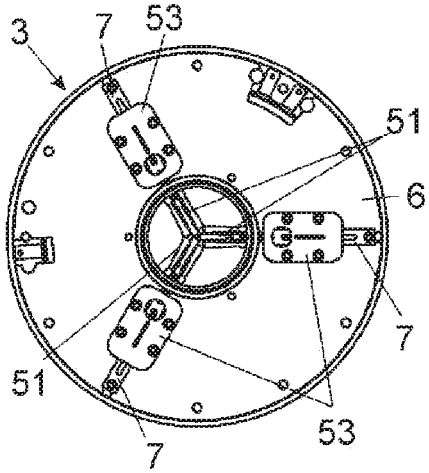

DEVICE FOR BURNISHING AND SMOOTHING METAL PARTS

OBJECT OF THE INVENTION

The invention, such as expressed in the title of present description, refers to a device for burnishing and polishing of metallic pieces, which provides several advantages and innovative features which are inherent to its particular configuration, which shall be described in detail further below and which involve a remarkable novelty in the current state of the art.

The object of present invention concretely centers on an electromagnetic device applicable for providing a mechanical interaction in the mechanical-galvanic processes for burnishing and polishing of metallic pieces, for example gold pieces and their alloys for jewelry, which in an innovative manner, in addition to presenting a smaller size which will allow for its use in any small workshop, presents an advantageous improved structural configuration of the elements for burnishing and polishing which intervene in said processes providing a greater efficiency and, consequently, a decrease in the amount of time and energy required for obtaining the same or even yet, better results.

FIELD OF THE INVENTION

The field of invention for instant application lies within the industry sector dedicated to burnishing and polishing of metal pieces, for example gold jewelry pieces and their alloys, especially encompassing the manufacture of apparatuses, machinery and tools for carrying out such functions.

BACKGROUND OF THE INVENTION

The mechanical-galvanizing processes for burnishing and polishing of metallic pieces, normally gold, silver or similar jewelry pieces or their alloys are well known in the state of the art, which involve the immersion of said pieces into a solution which constitutes an electrolytic medium and where mechanical actions are combined or yet, which are caused by the movement of the pieces, fixed unto a mobile support, into a solution which incorporates particles in suspension, or yet which are provoked by means of brushes which propel the particles towards the pieces, in which case, it may be these which present the movement.

As an example of the above, and referencing the current state of the art, various documents can be cited related to the polishing of metal pieces. By means of document ES2343298A1 a "Means, Procedure and Device for the superficial treatment of the surfaces of gold pieces or their alloys" is known, in which the means contains thiocyanic acid HNCS or a salt thereof and preferably a substance which elevates the viscosity to an appropriate level. The articles to be polished submerged in a medium of chemically inert particles embedded in the electrolytic medium when passing an electric current and connected to the positive pole; develop an anodic coating with electric resistivity which is higher than the electrolyte in its set. The device ensures the fastening and electric connection of the articles once they are placed in movement within the particle bedding.

Patent ES2239912 A1 makes known a process of "electrolytic polishing for metals in amphipathic molecules emulsions" in which the pieces come into contact with the electrolyte through immersion or by means of projection thereof over the surface. The electrolyte used is a heterogeneous system which contains organic substances, polar substances, amphipathic molecules and inert particles in suspension.

Patent WO2007/121999 makes known a "solution for the electrochemical polishing of metal articles" in which it similarly describes a procedure and a device for polishing by means of electric current application between an anode and a cathode, where the anode is the article to be treated. The device comprises a recipient with the solution; the recipient being vertically divided by a separator which defines two glasses intercommunicated on their lower part through a mesh or platen with orifices.

Similarly, as highlighted above, machines or devices are known for the application thereof or other similar mechanical-galvanic procedures which are based on the passage of electric current and which additionally combine mechanical operations through propelling elements consisting of a single block of brushes which are set in a horizontal position and which are displaced in an alternative circular or oval movement to attack the pieces or articles to be burnished and polished which are submerged in the electrolytic solution coupled unto a supporting element which is also structurally horizontal, all of which causes its functioning to not be optimal, given that they produce splashing of the solution with the cited brush movement and that its attack of the pieces always be undertaken in one same direction. Additionally, these machines are generally made up of elements which have a large volume and a complex configuration which make them non-viable for placing them in jewelry establishments, forcing the latter to having to transport the pieces to specialized places, thereby making them inconvenient in terms of travel and/or lengthened amount of time for carrying out the work, as well as making it impossible for the client to watch the process in situ.

The objective of present invention is therefore, to develop an improved device for the polishing and burnishing of metal pieces processes, where it should be highlighted that, at least on behalf of applicant, no other device is known which presents the technical, structural and constitutive features which are similar to those hereby recommended and accordingly claimed.

EXPLANATION OF THE INVENTION

The device for burnishing and polishing of metallic pieces proposed by this invention is configured as a notable novelty within the field of the application, whereby the characterizing feature details which distinguish it, are conveniently claimed in the final claims which accompany present description.

Thus, what the invention proposes, is as previously described above, an electrochemical device with the end goal of providing mechanical interaction in combination with a mechanical-galvanic process for burnishing and polishing of metallic pieces, through the burnishing elements which it incorporates and which is differentiated by its particular configuration, disposition and movement thereof in combination with the particular configuration and structure of the support means with which it consists of the pieces to be polished in the electrolytic solution.

In a concrete manner, the device of the invention comprises a circular recipient, where the solution is incorporated into, with a main body unto which are coupled a series of brushes, which constitute the propulsion means, which are set vertically and radially and an extractable head, where a central frame element is incorporated as a support for the pieces in the shape of a vertical rod or rods on which the cited brushes act upon by means of a concentric approach and retreating movement to said element.

Preferably, the device consists with at least three radially set brushes, in such a way that between them they are at a 120° angle, to attack the pieces from three angles concurrently, yet the possibility of existence of a greater number of brushes is not dismissed, in any event, they are set radially in equidistant angles.

On its part, the frame element presents, preferably, also a rotational movement on itself which prevents that any area of the pieces remains not being attacked.

Through all of the above the advantages provided by present device becomes evident in light of the existent systems:

- Its simplicity and smaller size allows for implementing it in jewelry workshops or establishments themselves.
- By placing the pieces centrally and being attacked radially by the brushes, consisting with at least three placed at 120° angles from each other, the interaction of the brushes combined with the rotational movement of the support is more efficient, as they attack the pieces from all the angles encompassing all the corners thereof, as opposed to the horizontal brushes which always attack in one same direction.
- The concentric approaching and retreating movement of the brushes on the center for attacking pieces placed on the central supporting element, avoids the possibility of splashes and vibrations inherent of the machine, which allows for an increase in the number of revolutions or the movement velocity such that the polishing is completed in lesser amount of time and thus, less energy is consumed, as opposed to the existing system in which the brushes are all situated in a horizontal block presenting a circular or oval movement as a consequence of which many more splashes are produced and, therefore, the revolutions must be limited, or otherwise objectionable losses of the electrolytic solution would occur, which would end up making the procedure ineffective.

The described device for polishing and burnishing for metallic pieces, therefore, is an innovative structure with structural and constitutive features which were unknown until now for the purposes intended, which are reasons which taken in conjunction with its practical use, grant it sufficient basis for obtaining the protection being sought for it.

DESCRIPTION OF FIGURES

To complement the description being undertaken, and with the objective of helping to render better comprehension of the features of the invention, together with the present description, as integral part of the same, a set of figures are attached, whereby in an illustrative manner and not a limitative one, the following is represented:

FIGS. 4A and 4B show a lower plan view of the main body of the device, represented with the brushes in an open and closed position, respectively.

FIGS. 5A and 5B show an upper view of the main body which incorporates the displacement guides of the brushes, also represented in an open and closed position, respectively.

PREFERRED EMBODIMENT OF THE INVENTION

Figure 1:
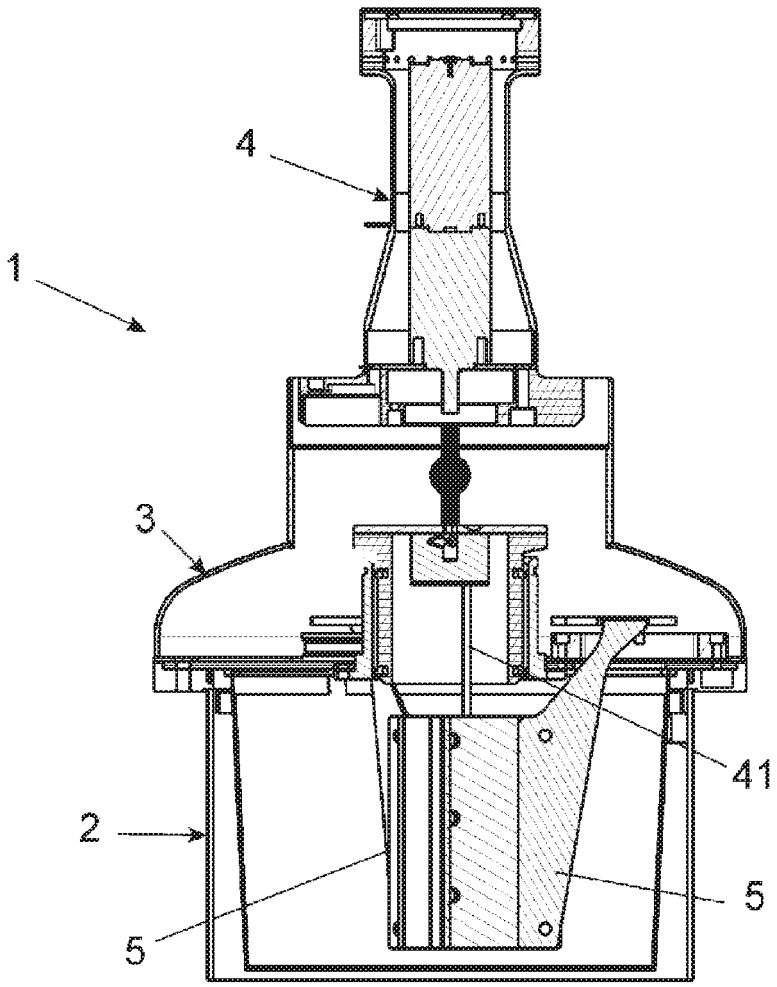
FIG. 1 shows a section view, according to a vertical cut, of an example of the device for burnishing and polishing of metallic pieces, object of the invention, represented with all of its elements mounted and coupled, in such a way that its general configuration and the main parts and elements it comprises can be seen, as well as the configuration and disposition thereof.

In light of the above mentioned figures and according to the adopted numbering, it can be appreciated that in them one can see the preferred embodiment, but not limitative of the described device for burnishing and polishing of metallic pieces, which comprises parts and elements which are described and indicated in detail as follows.

Such as can be seen in the figures, the device (1) in question, applicable to electrolytic processes for polishing and cleaning of jewelry pieces, is configured essentially from a tank (2) into which an electrolytic solution is introduced with a main body (3) which is coupled centrally and on its upper portion to an extractable head (4) which serves as a support element for the frame (41) unto which the pieces to be treated (not included in the figures) are placed, such that upon coupling it over the main body (3) of the tank (2) they are submerged in the solution. Additionally, said main body (3) contains three mobile propelling systems (5) which are activated by electromechanical means provided for this purpose on said main body, present an approach and retreating concentric displacement movement from the central point, acting from equidistant angles on the frame (41), and thus on the metallic pieces which are incorporated within it.

In the preferred embodiment of the device (1), the tank (2) is cylindrical and the main body (3), also having a circular plan, consists with a fastening disk (6) unto which some guides (7) are coupled radially, on which the propelling systems (5) are run, tracing the described approaching and retreating concentric synchronized movement from an open position (FIGS. 4-A and 5-A) on which they remain separated from each other and away from the center, to a closed position (FIGS. 4-A and 4-B) in which they join with each other at the center of the tank (2) coming in contact with the frame (41).

Figure 3:
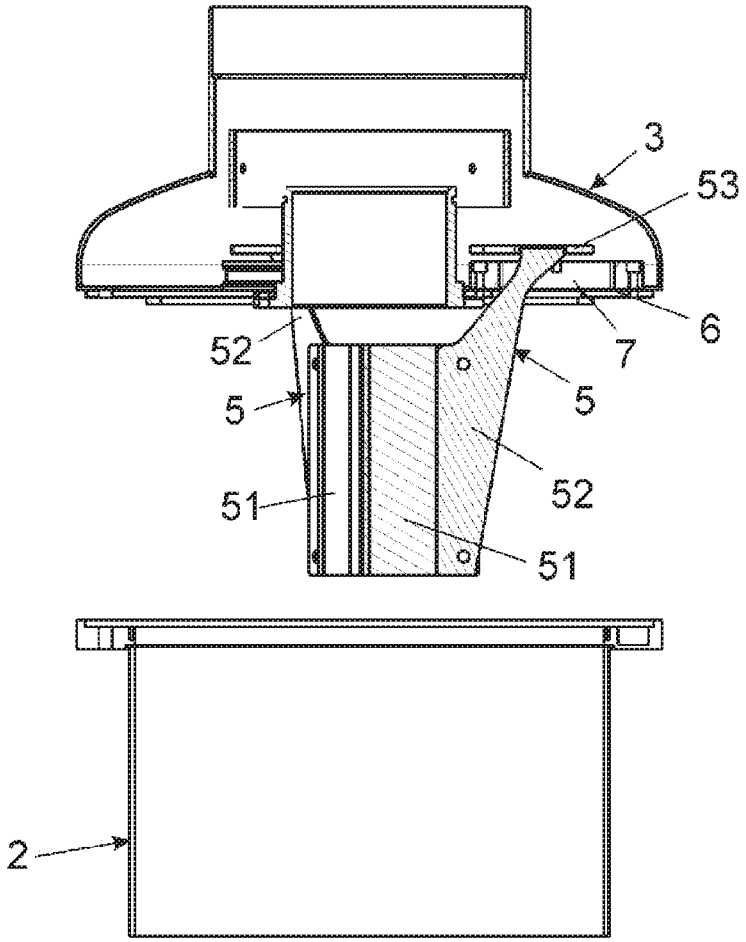
FIG. 3 shows a section view of the tank only with the main body where the brushes are incorporated, represented with the brushes separated from the tank thereby being able to more clearly see the configuration and disposition of such brushes.

As FIG. 3 shows, the propelling systems (5) have a vertical structure which comprises some brushes (51) made from a soft material, suitable for acting on the pieces without damaging them, and a support (52) unto which the sheets (51) are fixed and which, in turn, is coupled by means of a platen (53) to which the guides (7) are screwed unto on its upper portion.

Figure 2:
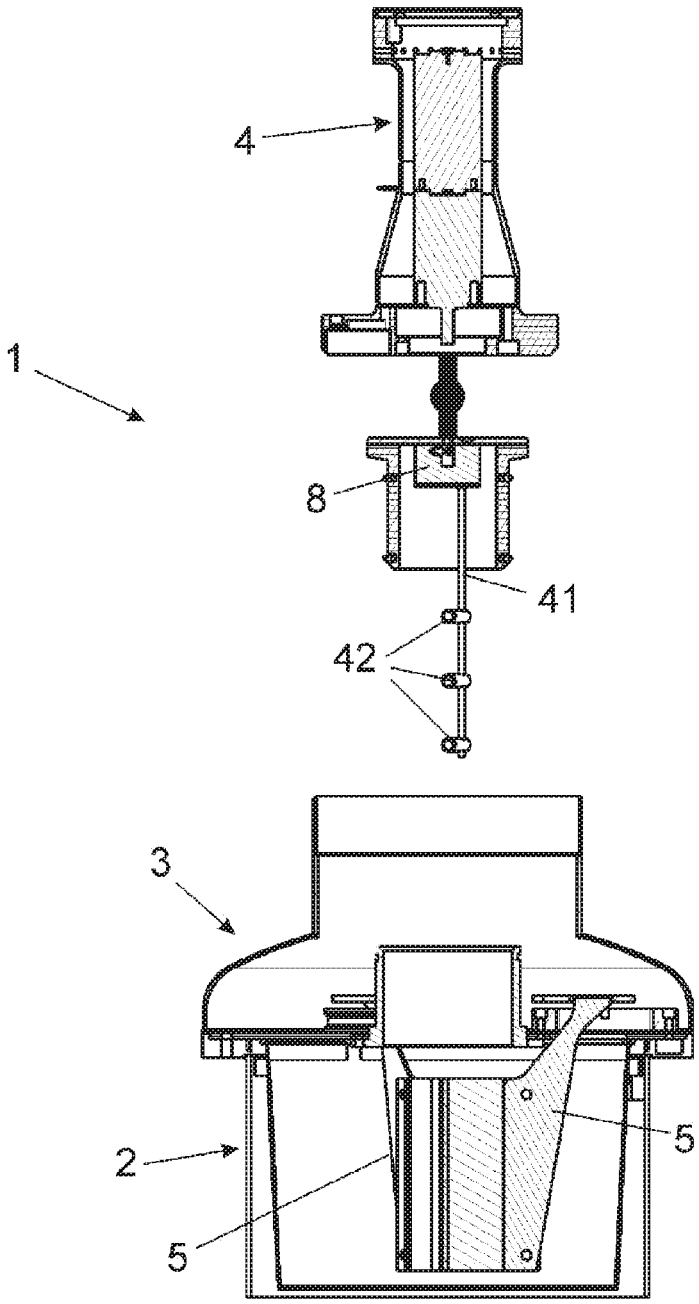
FIG. 2 shows a section view of the same example of the device, according to the invention, shown in the preceding figure, in this case represented with the head and the frame separated from the main body and tank, thereby allowing to more clearly be able to see the configuration and the disposition of the element of the frame for the pieces to be treated.

Meanwhile, the frame (41), which as previously highlighted, is coupled on its lower part unto an extractable head (4) which is coupled to the main body through a central orifice provided thereof and which also is incorporated in the tank (2), consists with, at least, one vertical rod, conveniently provided along the length of the same with fastening means (42), clearly visible in FIG. 2; rod which is coupled on its upper end to a shell (8) provided for this purpose on the lower central part of the frame (41).

This frame (41) preferably, presents a rotational movement, driven by electromagnetic means provided on the head in such a way that, at least one rod which constitutes it, with the pieces to be treated, turns at the center of the tank (2) at the same time that it is attacked by the action of the concentric movement of the propelling systems (5).

Having described the nature of present invention sufficiently, as well as having undertaken its practice, it is considered that it is not necessary to further explain it in order for a person skilled in the art to understand its scope and the advantages it provides, noting that within its essence, other undertakings of it which could differ in their detail from that of the example title of the invention could be carried out, all of which would attain equally the protection sought, as long as its fundamental principle is not altered, changed or modified.

The invention claimed is:

1. Device for polishing and burnishing of metallic pieces, applicable to mechanical-galvanic burnishing and polishing processes, comprising:

a main body;

a tank configured to receive an electrolytic solution;

a frame comprising a support member configured to retain pieces to be treated, the frame positioned substantially in the center of the main body, whereby the frame further comprises an extractable head;

a plurality of propelling systems disposed within the main body, each of the plurality of propelling systems comprising brushes, the plurality of propelling systems positioned in the main body radially surrounding the frame, whereby each of the propelling systems is configured to be driven electromechanically in a first direction toward the frame and in a second direction retreating from the frame.

2. Device for polishing and burnishing of metallic pieces according to claim 1, whereby the plurality of propelling systems are configured in a first, open position wherein each propelling system remains separated from each other and away from the center, whereby when the plurality of propelling systems move in the first direction they assume a second, closed position wherein each of the propelling systems contact the frame.

3. Device for polishing and burnishing of metallic pieces according to either claim 1 or 2, whereby the propelling systems are coupled to a lower part of the main body and mounted above the tank.

4. Device for polishing and burnishing of metallic pieces according to claim 3, whereby the tank is cylindrical and the main body comprises a circular plan.

5. Device for polishing and burnishing of metallic pieces according to claim 4, whereby the main body comprises a fastening disk unto which guides are coupled radially, on which the propelling systems are run, tracing an approaching and retreating concentric synchronized movement to the center.

6. Device for polishing and burnishing of metallic pieces according to claim 5, whereby the brush of each of the propelling systems comprises a vertical structure.

7. Device for polishing and burnishing of metallic pieces according to any of claim 2, whereby the frame is configured for rotational movement, and wherein the frame rotates at the center of the tank when the propelling systems are in the second, closed position.

8. Device for polishing and burnishing of metallic pieces according to any of claim 1 or 7, whereby the frame comprises a vertical rod provided with fastening means configured to retain the pieces to be treated.

9. Device for polishing and burnishing of metallic pieces according to claim 8, whereby the vertical rod has an upper end and a lower end, wherein the upper end is coupled to a shell provided in the main body.

* * * * *